US011581640B2

(12) United States Patent
Eleftheriades et al.

(10) Patent No.: US 11,581,640 B2
(45) Date of Patent: Feb. 14, 2023

(54) PHASED ARRAY ANTENNA WITH METASTRUCTURE FOR INCREASED ANGULAR COVERAGE

(71) Applicant: Huawei Technologies Canada Co., Ltd., Kanata (CA)

(72) Inventors: Georgios V. Eleftheriades, Scarborough (CA); Gleb Andreyevich Egorov, Toronto (CA)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 16/716,035

(22) Filed: Dec. 16, 2019

(65) Prior Publication Data

US 2021/0184351 A1 Jun. 17, 2021

(51) Int. Cl.
*H01Q 3/30* (2006.01)
*H01Q 1/34* (2006.01)
(Continued)

(52) U.S. Cl.
CPC ..... *H01Q 3/30* (2013.01); *H01Q 1/34* (2013.01); *H01Q 1/425* (2013.01); *H01Q 15/0086* (2013.01)

(58) Field of Classification Search
CPC .... H01Q 15/02; H01Q 15/0006; H01Q 15/10; H01Q 19/06; H01Q 3/30; H01Q 1/425; H01Q 1/34; H01Q 15/0086
See application file for complete search history.

(56) References Cited

U.S. PATENT DOCUMENTS 6,225,939 B1 * 5/2001 Lind ..... H01Q 15/10 342/4
6,512,487 B1 1/2003 Taylor et al.
(Continued)

FOREIGN PATENT DOCUMENTS

CN 107017470 A 8/2017
EP 3560111 A2 10/2019
WO 2018160881 A1 9/2018

OTHER PUBLICATIONS

H. Steyskal et al. On the Gain-versus-Scan Trade-offs and the Phase Gradient Synthesis for a Cylindrical Dome Antenn. IEEE Transactions on Antennas and Propagation, 27(6), Nov. 1979. pp. 825-831.
(Continued)

*Primary Examiner* — Andrea Lindgren Baltzell
*Assistant Examiner* — Yonchan J Kim
(74) *Attorney, Agent, or Firm* — BCF LLP

(57) ABSTRACT

The disclosed structures and methods are directed to antenna systems configured to transmit and receive a wireless signal in and from different directions. An antenna for transmission of electromagnetic (EM) waves comprises a phased array and a metastructure. The phased array has radiated elements configured to radiate the EM waves. The metastructure is located at a phased array distance from the phased array to receive the EM waves at the first angle and to transmit the EM waves at a second angle, the second angle being larger than the first angle. The metastructure comprises three impedance layers arranged in parallel to each other and each impedance layer comprising a plurality of metallization elements. Each metallization element has a first dipole and a pair of first capacitance arms located on each end of the first dipole approximately perpendicular to the first dipole.

13 Claims, 9 Drawing Sheets

(51) Int. Cl.
*H01Q 15/00* (2006.01)
*H01Q 1/42* (2006.01)

(56) References Cited

U.S. PATENT DOCUMENTS

| | | | | |
|---|---|---|---|---|
| 7,804,439 | B2 * | 9/2010 | Yoshida | H01Q 17/002 342/4 |
| 2010/0277398 | A1 * | 11/2010 | Lam | H01Q 15/02 343/909 |
| 2012/0274525 | A1 | 11/2012 | Lam et al. | |
| 2013/0016432 | A1 * | 1/2013 | Liu | H01Q 15/02 359/618 |
| 2015/0255877 | A1 * | 9/2015 | Liu | H01Q 15/0086 343/909 |
| 2017/0162949 | A1 | 6/2017 | Yang et al. | |
| 2018/0351250 | A1 | 12/2018 | Achour et al. | |
| 2019/0109387 | A1 | 4/2019 | Samadi Taheri et al. | |
| 2020/0028261 | A1 * | 1/2020 | Foo | H01Q 19/06 |

OTHER PUBLICATIONS

H. Kawahara et al,. Design of Rotational Dielectric Dome with Linear Array Feed for Wide-Angle Multibeam Antenna Applications. Electronics and Communications in Japan, Part 2, vol. 90, No. 5, 2007, pp. 49-57.

T. A. Lam et al,. Steering Phased Array Antenna Beams to the Horizon Using a Buckyball NIM Lens. Proceedings of the IEEE, vol. 99, No. 10, Oct. 2011, pp. 1755-1767.

M. Moccia et al., Transformation-Optics-Based Design of a Metamaterial Radome for Extending the Scanning Angle of a Phased Array Antenna. arXiv preprint arXiv:1703.03793, May 2, 2017. pp. 1-9.

A. Epstein et al,. Arbitrary Power-Conserving Field Transformations With Passive Lossless Omega-Type Bianisotropic Metasurfaces. IEEE Transactions on Antennas and Propagation, vol. 64, No. 9, Sep. 2016, pp. 3880-3895.

Kasemodel, Justin A. et al, Wideband Planar Array With Integrated Feed and Matching Network for Wide-Angle Scanning, IEEE, Transactions on Antennas and Propagation, vol. 61, No. 9. Sep. 30, 2013, 10 pages.

International Search Report and Written Opinion of PCT/CN2020/134669 issued by the ISA/CN; Guohui Sun; Mar. 8, 2021.

Steyskal et al., "On The Gain-Versus-Scan Trade-Offs and The Phase Gradient Synthesis For a Cylindrical Dome Antenna", IEEE Transactions on Antennas and Propagation, Nov. 1979, pp. 825-831, vol. 27; No. 6.

Epstein et al., "Arbitrary Power-Conserving Field Transformations With Passive Lossless Omega-Type Bianisotropic Metasurfaces", IEEE Transactions on Antennas and Propagation, Sep. 2016, pp. 3880-3895, vol. 64; No. 9.

Kawahara et al., "Design of Rotational Dielectric Dome with Linear Array Feed for Wide-Angle Multibeam Antenna Applications", Electronics and Communications in Japan, Wiley Periodicals, Inc., 2007, pp. 49-57, Part 2, vol. 90, No. 5.

Lam et al., "Steering Phased Array Antenna Beams to the Horizon Using a Buckyball NIM Lens", Proceedings of the IEEE, Oct. 2011, pp. 1755-1767, vol. 99, No. 10.

Moccia et al., "Transformation-Optics-Based Design of a Metamaterial Radome for Extending the Scanning Angle of a Phased-Array Antenna", IEEE Journal on Multiscale and Multiphysics Computational Techniques, 2017, pp. 159-167, vol. 2.

Office Action dated Oct. 18, 2022 by the Indian Patet Office in connection with the corresponding application No. 202247033774.

Hu Yun et al: "A Digital Multibeam Array With Wide ScanningAngle and Enhanced Beam Gain for Millimeter-Wave MassiveMIMO Applications",IEEE Transactions On Antennas and Propagation,IEEE, USA,vol. 66, No. 11, Nov. 1, 2018 (Nov. 1, 2018), pp. 5827-5837,XP011694232,ISSN: 0018-926X, DOI: 10.1109/TAP.2018.2869200 [retrieved on Oct. 29, 2018].

Bah Alpha O et al: "A Wideband Low-Profile Tightly CoupledAntenna Array With a Very High Figure of Merit",IEEE Transactions On Antennas and Propagation,IEEE, USA,vol. 67, No. 4, Apr. 1, 2019 (Apr. 1, 2019), pp. 2332-2343,XP011718598,ISSN: 0018-926X, DOI: 10.1109/TAP.2019.2891460[retrieved on Apr 4, 2019].

Extended European Search Report; Mitchell-Thomas, R.; dated Nov. 25, 2022.

* cited by examiner

PHASED ARRAY ANTENNA WITH METASTRUCTURE FOR INCREASED ANGULAR COVERAGE

CROSS-REFERENCE TO RELATED APPLICATIONS

This is the first application filed for the instantly disclosed technology.

FIELD OF THE INVENTION

The present invention generally relates to the field of wireless communications and, in particular, to antennas.

BACKGROUND

To support a wide bandwidth and high throughput data rates, 5G telecommunication systems use a millimeter-wave spectrum with frequencies higher than 30 gigahertz (GHz). At such frequencies, a line-of-sight propagation prevails which demands development of point-to-point data links.

In order to improve propagation of a wireless signal in point-to-point data links, scannable phased arrays may be used in base stations (BS) and user equipment (UE). Transceivers with scannable phased arrays may have many elements, such as scannable phased arrays with 16×16 elements, and may be capable of providing a wide beam-scanning functionality, high gains and narrow beamwidths needed to maintain robust data links with moving UE. However, the scannable phased arrays with so many elements are not only costly, but are also known to increase the power dissipation.

Extending the scan range of phased arrays may be possible with relatively thick dielectric lenses which may be shaped in the form of a hemispherical dome. Such dielectric domes are bulky, relatively thick, and have a complex three-dimensional shape. Furthermore, the enhancement in the scan range obtained with the dielectric domes is accompanied by a degradation in directivity, some of which is attributed to reflections at the dielectric/air interfaces.

SUMMARY

An object of the present disclosure is to provide an antenna for transmission of electromagnetic (EM) wave. The antenna comprises a metasurface lens structure placed proximate to a conventional phased array.

The metasurface lens structure as described herein is configured to extend a scan range of the conventional phased array. For example, if the conventional phased array has lower-cost, simplified hardware (e.g. through sub-arraying) such that it is configured to radiate within a first scan range (e.g. −15 to 15 degrees), then the metasurface lens structure as described herein is configured to increase the scan range of the antenna to a second scan range which is larger than the first scan range (e.g. −30 to 30 degrees), while incurring minimum gain degradation.

In accordance with this objective, an aspect of the present disclosure provides an antenna for transmission of electromagnetic (EM) waves. The antenna comprises a phased array having radiating elements configured to radiate the EM waves; and a metastructure located at a phased array distance from the phased array to receive the EM waves at a first angle. The metastructure is configured to transmit the EM waves at a second angle, the second angle being larger than the first angle. The metastructure comprises three impedance layers arranged in parallel to each other and each impedance layer comprising a plurality of metallization elements, each metallization element having a first dipole and a pair of first capacitance arms positioned on each end of the first dipole approximately perpendicular to the first dipole.

In some embodiments, the plurality of metallization elements is configured to provide coupled electric and magnetic dipole responses.

In some embodiments, the phased array is configured to radiate the EM waves within a first scan range and the metastructure is configured to transmit the EM waves within a second scan range, the second scan range being larger than the first scan range.

The three impedance layers may comprise a pair of side impedance layers and a middle impedance layer located between the side impedance layers. The first dipoles located in the middle impedance layer may be shifted relative to first dipoles located in the side impedance layers. The first dipoles located in the middle layer may be shifted relative to the first dipoles located in the side impedance layers by approximately half a length of the first dipole located in the side impedance layers.

The metastructure may comprise at least one unit cell having portions of the three impedance layers, and at least one unit cell may comprise one metallization element in each of the side impedance layers and at least portions of middle-layer metallization elements in the middle impedance layer. In at least one unit cell, at least one of the middle-layer metallization elements located in the middle impedance layer may have dimensions different from dimensions of the metallization element located in the side impedance layers. Metallization elements located in the side impedance layers of the at least one unit cell may have different dimensions.

Each metallization element located in the side impedance layers may further comprise a second dipole positioned approximately perpendicular to the first dipole and crossing the first dipole, and a pair of second capacitance arms positioned on each end of the second dipole approximately perpendicular to the second dipole. The middle impedance layer may further comprise central elements positioned between the first capacitance arms of neighboring metallization elements located in the middle impedance layer. The metallization elements located in the middle impedance layer may further comprise third dipoles positioned approximately perpendicular to the first dipole located in the middle impedance layer and a pair of third capacitance arms positioned on each end of the third dipole approximately perpendicular to the third dipole.

In accordance with additional aspects of the present disclosure, there is provided a method for manufacturing of an antenna for transmission of EM waves. The method comprises determining a phased array distance; determining metastructure parameters for unit cells of a metastructure; based on the metastructure parameters, determining geometric parameters of metallization elements of the unit cells of the metastructure; and placing the metastructure at the phased array distance from the phased array, the metastructure having three impedance layers comprising the metallization elements having the geometric parameters.

The phased array distance may be determined based on a number of radiating elements of the phased array and desired directivity degradation of the antenna. The metastructure parameters for unit cells of the metastructure may be determined based on a frequency of operation of the phased array. The metastructure parameters for unit cells of the metastructure may be determined based on a desired ratio of a scan range of the antenna to a scan range of the phased array.

Implementations of the present disclosure each have at least one of the above-mentioned object and/or aspects, but do not necessarily have all of them. It should be understood that some aspects of the present disclosure that have resulted from attempting to attain the above-mentioned object may not satisfy this object and/or may satisfy other objects not specifically recited herein.

Additional and/or alternative features, aspects and advantages of implementations of the present disclosure will become apparent from the following description, the accompanying drawings and the appended claims.

BRIEF DESCRIPTION OF THE FIGURES

Further features and advantages of the present disclosure will become apparent from the following detailed description, taken in combination with the appended drawings, in which.

Figure 1:
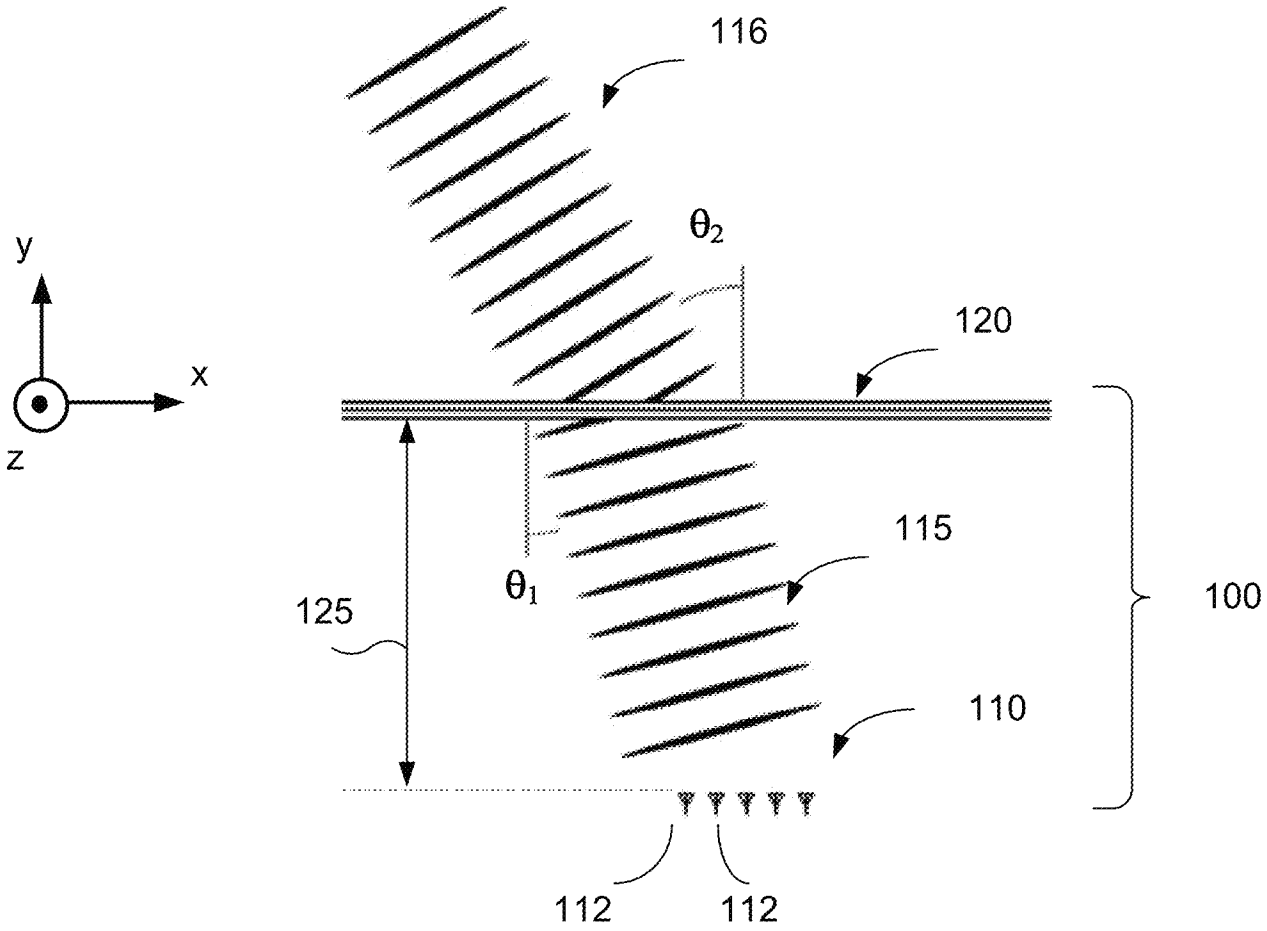
FIG. 1 depicts a side view of an antenna, in accordance with various embodiments of the present disclosure.

It is to be understood that throughout the appended drawings and corresponding descriptions, like features are identified by like reference characters. Furthermore, it is also to be understood that the drawings and ensuing descriptions are intended for illustrative purposes only and that such disclosures do not provide a limitation on the scope of the claims.

DETAILED DESCRIPTION

The instant disclosure is directed to address at least some of the deficiencies of the current implementations of antennas.

The technology described herein may be embodied in a variety of different electronic devices (EDs) including base stations (BSs), user equipment (UE), etc.

The electromagnetic (EM) wave that propagates inside and is radiated by the antenna may be within a radio frequency (RF) range and is referred herein to as an RF wave. In some embodiments, the RF wave may be within a millimeter wave range. For example, the frequencies of the RF wave may be between about 30 GHz and about 300 GHz. In some other embodiments, the RF wave may be in a microwave wave range. For example, the frequencies of the RF wave may be between about 1 GHz and about 30 GHz.

As used herein, the term "about" or "approximately" refers to a +/−10% variation from the nominal value. It is to be understood that such a variation is always included in a given value provided herein, whether or not it is specifically referred to.

Unless defined otherwise, all technical and scientific terms used herein have the same meaning as commonly understood by one of ordinary skill in the art to which this invention belongs.

The antenna as described herein may, in various embodiments, be formed from appropriate features of a multisubstrate printed circuit board (PCB), such as features formed by etching of conductive substrates, vias, and the like. Such a PCB implementation may be suitably compact for inclusion in wireless communication equipment, such as mobile communication terminals, as well as being suitable for cost-effective volume production.

Referring now to drawings, FIG. 1 depicts a side view of an antenna 100, in accordance with at least one non-limiting embodiment of the present disclosure.

The antenna 100 comprises a phased array 110 (also referred to herein as "phased array antenna 110") and a metasurface lens structure 120 (also referred to herein as "metastructure 120") located at a phased array distance 125 from phased array 110. In the illustrated embodiment, the metastructure 120 is located in a plane positioned in a parallel manner to the phased array 110. In some embodiments, phased array 110 may be located in a plane which is not positioned in a parallel manner to the phased array 110.

The phased array 110 comprises radiating elements 112 arranged in an array. In the illustrated embodiment, phased array 110 is configured to radiate EM waves 115 at a first angle $\theta_1$. The metastructure 120 is configured to receive radiation of incident EM waves 115 at first angle $\theta_1$ and to transmit refracted EM waves 116 at a second angle $\theta_2$. In at least one embodiment, second angle $\theta_2$ is larger than first angle $\theta_1$, and second angle $\theta_2$ operates to provide increased angular coverage of the EM waves. The antenna 100 is configured to operate (transmit and receive) EM waves at second angle $\theta_2$.

The metastructure 120 is configured to enhance a scan range $\Delta\theta_1$ of phased array 110 (referred to as "first scan range $\Delta\theta_1$"). Due to metastructure 120, the phased array scan range $\Delta\theta_1$ (also referred to as "scan range of the phased array") may be smaller than the overall scan range $\Delta\theta_2$ of antenna 100 (referred to as "second scan range $\Delta\theta_2$" and "scan range of antenna 100"). The phased array 100 of antenna 100 may have a simplified feeding network (e.g. having less connections, less phase-shifters and associated electronic elements) compared to more complex phased arrays configured to provide the same scan range as antenna 100 described herein.

Figure 2:
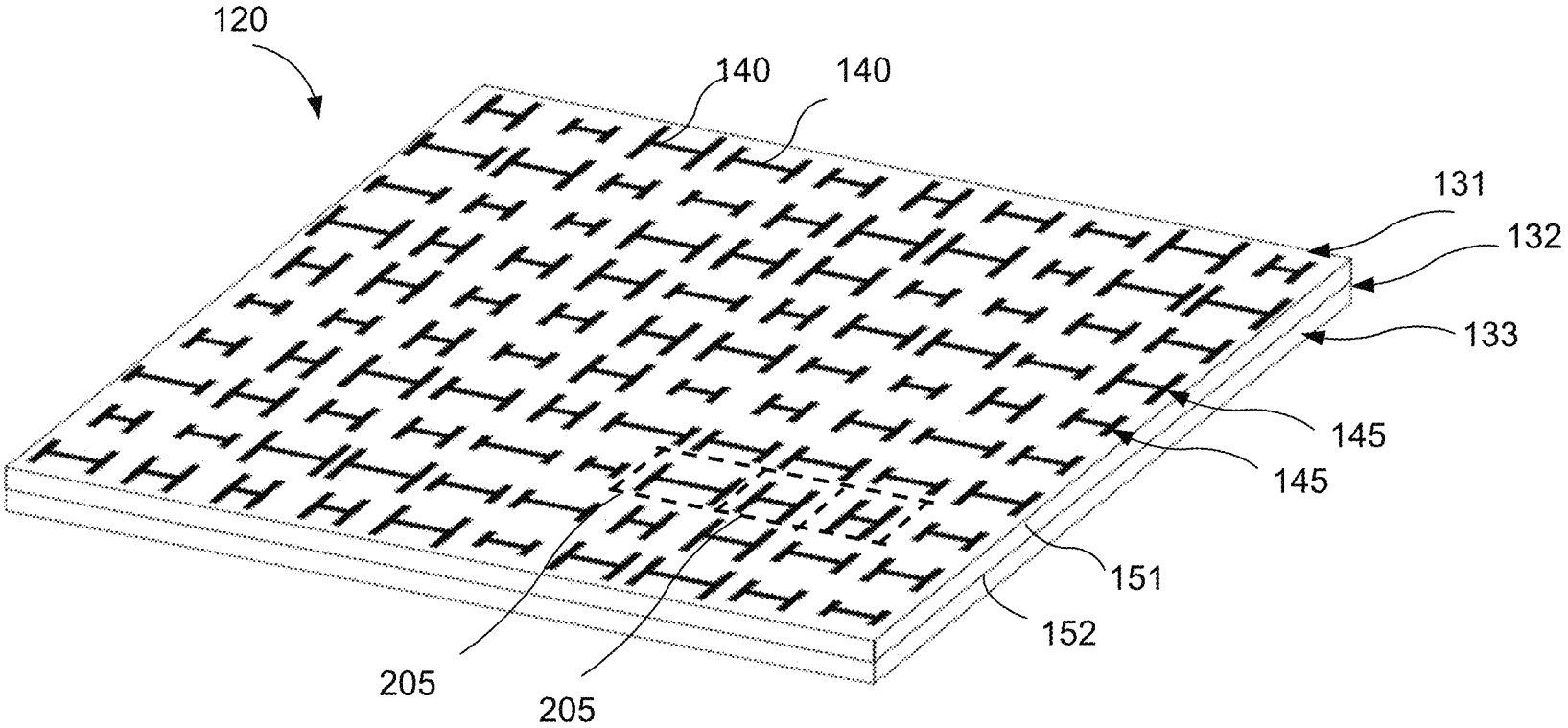
FIG. 2 depicts a perspective view of a metastructure, in accordance with various embodiments of the present disclosure.

FIG. 2 depicts a perspective view of metastructure 120, in accordance with at least one non-limiting embodiment of the present disclosure. Metastructure 120 comprises at least three impedance layers arranged in a parallel manner to each other: a first impedance layer 131, a second impedance layer 132 (also referred to as a "middle impedance layer 132"), and a third impedance layer 133 (first and second impedance layers 131, 133 are referred to collectively as "side impedance layers 131, 133"). Each impedance layer 131, 132, 133 has metallization elements 140 which may be arranged in rows 145, as illustrated in FIG. 2.

In at least one embodiment, impedance layers 131, 132, 133 are separated from each other by a first substrate 151 and second substrate 152. The substrates 151, 152 may be made of a dielectric material such as, for example, a dielectric having relative permittivity between about 3 and about 12. In some embodiments, the substrates 151, 152 may be made of the dielectric having relative permittivity of approximately 4. The substrates 151, 152 may be made of PCBs.

As illustrated in FIG. 2, metastructure 120 may be represented as a plurality of unit cells 205.

Figure 3:
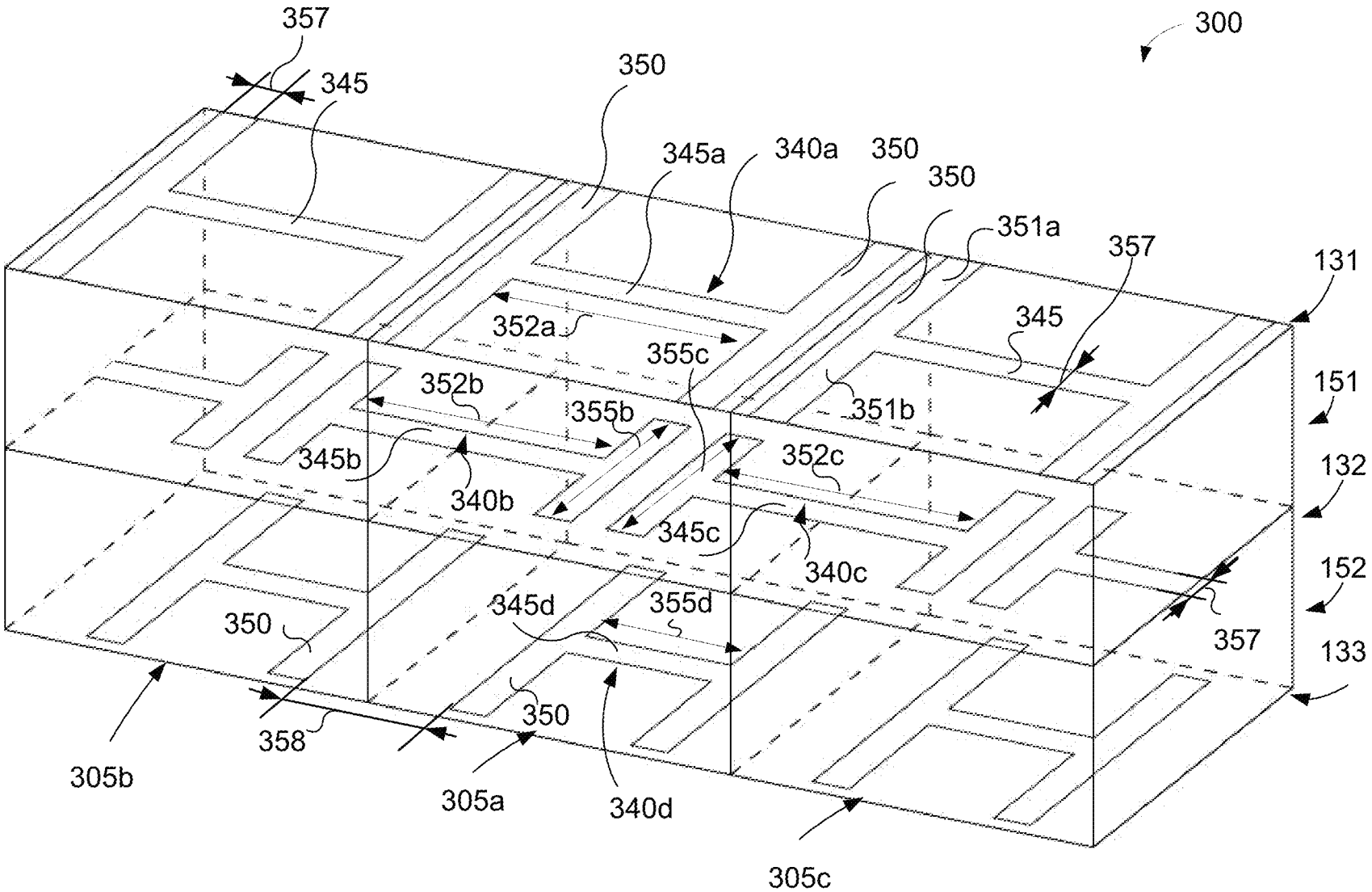
FIG. 3 depicts a perspective see-through view of a portion of the metastructure with three unit cells, in accordance with various embodiments of the present disclosure.

FIG. 3 depicts a perspective see-through view of a portion 300 of metastructure 120 with three unit cells 305*a*, 305*b*, 305*c* (referred to collectively as "unit cell(s) 305), in accordance with at least one non-limiting embodiment of the present disclosure. Each of the unit cells 305 comprises a first metallization element 340*a* in first impedance layer 131, a portion of a second metallization element 340*b* and a portion of a third metallization element 340*c* in second impedance layer 132, and a fourth metallization element 340*d* in third impedance layer 133. The metallization elements 340*a*, 340*b*, 340*c*, 340*d* are referred to herein collectively as metallization element(s) 340.

In the embodiment illustrated in FIGS. 1-2, each metallization element 340 is configured with a dipole 345 (depicted as dipoles 345*a*, 345*b*, 345*c*, 345*d* for metallization elements 340*a*, 340*b*, 340*c*, 340*d*, respectively) and a pair of capacitance arms 350 located on each end of dipole 345 and are positioned approximately perpendicular to dipole 345. The metallization elements 340 may be made of a metal material such as, for example, copper.

The dipoles 345*a*, 345*b*, 345*c*, 345*d* of metallization elements 340*a*, 340*b*, 340*c*, 340*d*, respectively, may have different lengths. Two capacitance arms 350 of one metallization element 340 have approximately equal lengths.

Two neighboring metallization elements 340, e.g. second metallization element 340*b* and third metallization element 340*c*, may have different dipole lengths 352*a*, 352*b*, 352*c* and different capacitance arm lengths 355*b*, 355*c*. Two neighboring capacitance arms 350 of a pair of neighboring metallization elements 340*b*, 340*c* may have different lengths and form an electrical capacity there between.

Each capacitance arm 350 is connected to corresponding dipole 345 approximately at a middle point of capacitance arm 350. Each capacitance arm 350 has thus two branches 351*a*, 351*b* which are approximately equal in length and are located on two sides of dipole 345, as illustrated in FIG. 3.

The widths 357 of dipoles 345 and capacitance arms 350 may be approximately equal. The dimensions of metallization elements 340, such as lengths and widths of dipoles 345 and capacitance arms 350, may be determined using full-field simulations (also known as full-wave numerical simulations analysis) based on initial metastructure configuration parameters, such as frequency of the EM wave, size of phased array 110, first scan range $\Delta\theta_1$, desired second scan range $\Delta\theta_2$, first angle $\theta_1$, and second angle $\theta_2$, etc.

Figure 4:
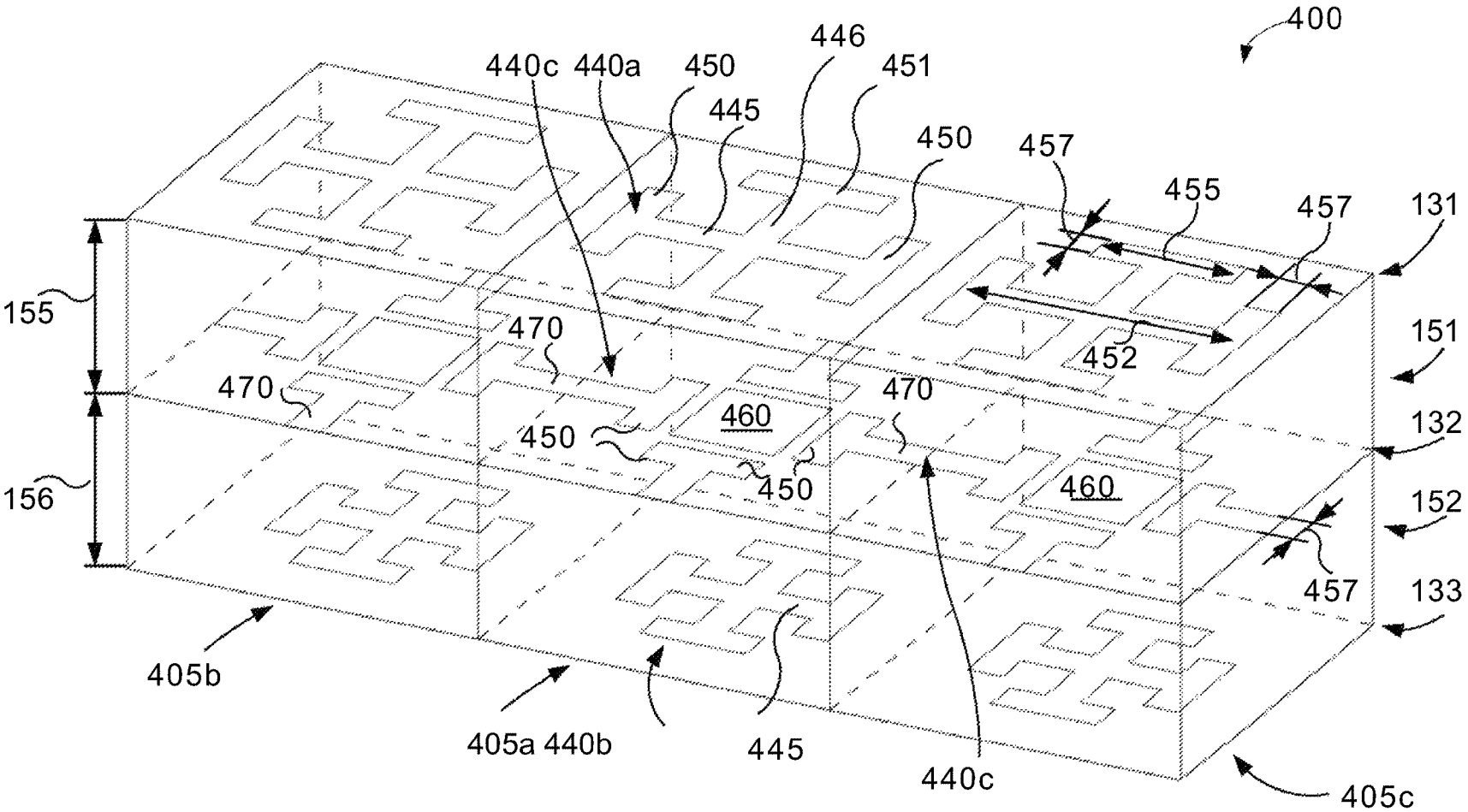
FIG. 4 depicts a perspective see-through view of another portion of the metastructure with alternative unit cells, in accordance with various embodiments of the present disclosure.

FIG. 4 illustrates a perspective see-through view of a portion 400 of metastructure 120 with alternative unit cells 405*a*, 405*b*, 405*c* (referred to herein collectively as alternative unit cell(s) 405), in accordance with at least one non-limiting embodiment of the present disclosure.

In such alternative unit cells 405, alternative metallization elements 440*a* in first impedance layer 131 and alternative metallization elements 440*b* in third impedance layer 133 have structures similar to each other.

The alternative metallization element 440 comprises a first dipole 445 and two capacitance arms 450 positioned approximately perpendicular to first dipole 445. In addition to first dipole 445 and capacitance arms 450, alternative metallization element 440 has a second dipole 446 positioned approximately perpendicular to first dipole 445. A second pair of capacitance arms 451 are positioned approximately perpendicular to second dipole 446.

The second (middle) impedance layer 132, located between first impedance layer 131 and third impedance layer 133 of alternative unit cell 405 comprises a central element 460 and portions of four middle-layer metallization elements 440*c*. Each middle-layer metallization element 440*c* has a middle-layer dipole 470 and corresponding capacitance arms 450. As depicted in FIG. 4, central element 460 is surrounded by capacitance arms 450 of four neighboring middle-layer metallization elements 440*c*.

The widths 457 of dipoles 445, 446, 470 and capacitance arm lengths 450, 451 may be approximately equal to each other and may be determined based on full-field simulations as described herein below. The alternative metallization elements 440 and central element 460 may be made of a metal material such as, for example, copper.

The central element 460 facilitates coupling of the aligned middle-layer dipoles 470. Dimensions of central element 460 and dimensions of metallization elements 440*a*, 440*b*, 440*c* may also be determined using full-field simulations based on initial metastructure configuration parameters, such as frequency of the EM wave, size of phased array 110, first scan range $\Delta\theta_1$, desired second scan range $\Delta\theta_2$, first angle $\theta_1$, and second angle $\theta_2$, etc.

Referring to FIGS. 2-4, thicknesses 155, 156 of substrates 151, 152, respectively, of metastructure 120 may be a tenth of a wavelength of EM wave 115 radiated by phased array 110. For example, thicknesses 155, 156 of substrates 151, 152 may be between about 0.25 mm and about 5 mm.

With reference to FIG. 3, in some embodiments, dipoles 345 of three impedance layers 131, 132, 133 of one unit cell 305 may be located in the same imaginary plane positioned approximately perpendicular to impedance layers 131, 132, 133. Similarly, with reference to FIG. 4, in some embodiments, dipole 445 of alternative metallization element 440*a* in first impedance layer 131 and dipole 445 of alternative metallization element 440*b* in third impedance layer 133 of one unit cell 405 may be located in one imaginary plane positioned perpendicular to impedance layers 131, 132, 133.

Referring now to FIG. 1, phased array distance 125 may depend on the frequency (wavelength) of operation of phased array 110 and a size of phased array 110 (e.g. number of radiating elements 112 and the distance between them). In some embodiments, phased array distance 125 may have values between several wavelengths and dozens of wavelengths of EM waves 115 radiated by phased array 110. The phased array distance 125 may be determined based on the size of phased array 110 of antenna 100 and based on the desired directivity degradation that may be acceptable in operation of antenna 100.

In the construction of metastructure 120, first impedance layer 131 may be attached to first substrate 151, and third impedance layers 133 may be attached to second substrate 152. The second impedance layer 132 may be attached either to first substrate 151 or second substrate 152. The first and second substrates 151, 152 with the attached impedance layers 131, 132, 133 may then be attached to each other with a material adapted to attach materials used for first and second substrate 151, 152. In some embodiments, first and second substrates 151, 152 may be glued with an epoxy. In some embodiments, first and second substrates 151, 152 with the attached impedance layers 131, 132, 133 may be cured in an oven.

In some embodiments, metastructure 120 may have more than three impedance layers, and pairs of impedance layers of such metastructure 120 may be separated by substrates. Metastructure 120 with more than three impedance layers has more degrees of freedom in numerical simulations when determining dimensions of unit cells 205, 305, 405 and metallization elements 340, 440. In addition, higher number of impedance layers may permit to increase or otherwise control the bandwidth of EM wave.

In some embodiments, PCB manufacturing techniques may allow embedding of control elements in metastructure 120, such as switches or varactors, to improve functionality and performance of antenna 100. The surface of metastructure 120 may remain flat thus alleviating the need for manufacturing 3D-shaped structures.

The metastructure 120 as described herein may remain reflectionless while the beam of EM waves radiated by phased array 110 is scanned, i.e. with variation of first angle $\theta_1$, thus reducing losses and increasing overall efficiency.

In some embodiments, metastructure 120 may have a form of a radome over phased array 110.

Parameters of unit cells 305, 405, such as dipole lengths 352, 452 and capacitance arm lengths 355, 455 of metallization elements 340, 440, may be determined using a unit cell simulation model described below.

Referring to FIG. 1, a general boundary condition between incident and transmitted fields of corresponding incident and transmitted EM waves 115, 116 may be provided for metastructure 120. An equivalence principle of electromagnetics states that surface electric and magnetic currents facilitate a transition between the incident and transmitted fields. These currents have to be set up on the metastructure 120 by the incident and transmitted fields.

Referring again to FIG. 1, in the illustrated embodiment, metastructure 120 is assumed to be positioned in a y=0 plane and exhibits no variation in the z-direction. The incident and transmitted electric fields are assumed to have only z-component that is not zero, i.e. only the transverse electric (TE) polarization is considered.

Bianisotropic sheet transition conditions (BSTCs) at metastructure 120 may then be characterized as follows:

$$\tfrac{1}{2}(E'_z+E_z)=-Z(H'_x-H_x)-K(E'_z-E_z), \quad (1)$$

$$\tfrac{1}{2}(H'_x+H_x)=-Y(E'_z-E_z)+K(H'_x-H_x), \quad (2)$$

where Z is a metastructure's electric impedance, Y is a metastructure's magnetic admittance and K is a magneto-electric coupling coefficient. The coefficients Z, Y, and K are also referred to herein as "metastructure parameters Z, Y, and K".

In equations (1)-(2), $E_z$ and $E'_z$ are an incident and transmitted tangential electric fields, respectively; and $H_x$ and $H'_x$ are an incident tangential magnetic field and a transmitted tangential magnetic field, respectively.

The surface characterization coefficients K, Y, Z in BSTCs equations (1)-(2) are also functions of the x-coordinate along the surface, and such dependence is omitted in equations (1)-(2) for brevity. It may be noted that a transmission side of metastructure 120 may be represented by a plane $y=0^+$ and an incident side of metastructure 120 may be represented by $y=0^-$.

The BSTCs equations (1)-(2) may be obtained by combining conventional electromagnetic boundary conditions with a generalized form of Ohm's law which relates average tangential electric and magnetic fields on a surface to the surface's currents. The conventional Ohm's law for a surface teaches that the average tangential electric field on the surface is equal to the surface's impedance multiplied by the surface's electric current. Another law relates an average tangential magnetic field to a magnetic current via the surface magnetic admittance and allows for magneto-electric coupling. The magneto-electric coupling allows for magnetic current excitation via applied electric field and electric current excitation via applied magnetic field.

For metastructure 120 to be passive and lossless, incident and transmitted fields $E_z$, $E'_z$, $H_x$, $H'_x$ need to satisfy Maxwell's equations and a local power conservation condition at metastructure 120. To satisfy the local power conservation condition at every location of metastructure 120, a real power flow into metastructure 120 on one side of metastructure 120 needs to be equal to a real power flow on the other side of metastructure 120. Using y-component of Poynting vector $\Re\{S_y\}$, the local power conservation may be expressed as:

$$\Re\{S_y\}=\Re\{E_zH^*_x\}=\Re\{E'_zH'^*_x\}=\Re\{S'_y\}, \quad (3)$$

where H* is a complex conjugate of the H field, and x-dependence is omitted for brevity.

If fields on both sides of metastructure 120 are postulated to satisfy equation (3), it is possible to determine values of metastructure parameters Z, Y, and K which would satisfy equations (1) and (2).

The metastructure 120 has a structure of so-called bi-anisotropic Huygens's metasurface. To achieve reflectionless operation, metastructure 120 contains metallization elements 140, 340, 440, discussed above, that are configured to provide both an electric response and a magnetic response and these two types of responses are also coupled (so-called "bi-anisotropy").

As illustrated in FIGS. 2-4, it is assumed that that metastructure 120 is composed of unit cells 205, 305, 405 with each unit cell 205, 305, 405 acting as an individual scatterer. The metastructure parameters Z, Y, and K may be first determined for each unit cell 205, 305, 405. Then, parameters of unit cells 205, 305, 405, such as lengths of dipoles and distance between impedance layers 131, 132, 133 may be determined from metastructure parameters Z, Y, and K.

The metastructure 120 having metastructure parameters Z, Y, and K that satisfy equations (1)-(3) may be passive and lossless. The metastructure 120 is lossless when losses experienced by EM waves refracted from metastructure 120 are zero or almost zero. The metastructure 120 is passive when the metastructure 120 does not contribute any added EM energy. In some embodiments, metastructure 120 is passive and lossless when metastructure parameters Z and Y have imaginary values and metastructure parameter K is a real number.

According to a conventional transmission line theory, unit cell 205, 305, 405 may act as a three-stub tuning network. Parameters of unit cells 205, 305, 405 that provide the desired values of metastructure parameters Z, Y, and K may be determined when tangential fields are known. The tangential fields $E'_z$, $H'_x$ may be determined based on the desired ratio of second angle $\theta_2$ to first angle $\theta_1$, i.e. $\theta_2/\theta_1$, of metastructure 120, as described herein below.

To simulate operation of antenna 100, it was assumed that incident field 115 was transmitted towards metastructure 120 by phased array 110 which comprised sixteen (16) uniformly excited radiating elements 112. The spacing between elements was a half of a wavelength λ, where wavelength λ is a free-space wavelength (measured in meters) corresponding to the frequency of operation of antenna 100. The phased array radiating elements 112 were assumed to be infinite lines of current, extending in the z-direction, which allow for the two-dimensional treatment of the problem.

The beam of incident EM wave 115 was limited to a first scan range $\Delta\theta_1$ where $\theta_1=\pm 15°$ off broadside. It was desired for metastructure 120 to increase scan range $\Delta\theta_1$ of phased array 110 to second scan range $\Delta\theta_2$, where $\theta_2=\pm 30°$. Thus, the simulated embodiment of metastructure 120 was configured to double scan range $\Delta\theta_1$ of phased array 110.

In the simulated embodiment, frequency of operation was 10 GHz and phased array distance 125 was 40λ=1.2 m. Such phased array distance 125 of 40λ was selected in order to make sure that metastructure 120 is as far as possible from phased array 110 with available computational resources.

In some embodiments, metastructure 120 may double first scan range $\Delta\theta_1$ when an object is placed at its focal point which is located at a focal length f=−40λ.

In simulations, it can be assumed that electric and magnetic fields $E'_z$, $H'_x$ on the transmission side of metastructure 120 ($y=0^+$) are identical to fields produced by an infinite line of current located at the focal point of metastructure 120 located at y=f=−40λ. Using the geometry described above, the transmitted electric and magnetic fields $E'_z$, $H'_x$, tangential to metastructure 120 may be written as:

$$E'_z = \frac{k}{\omega\epsilon} H_0^{(2)}\left(k\sqrt{x^2+f^2}\right), \tag{4}$$

$$H'_x = \frac{jf}{\sqrt{x^2+f^2}} H_1^{(2)}\left(k\sqrt{x^2+f^2}\right), \tag{5}$$

where $H_0^{(2)}(\bullet)$ is a Hankel function of the second kind of order 0, $H_0^{(2)}(\bullet)$ is the Hankel function of the second kind of order 1.

In equations (4)-(5), f is the focal length of metastructure 120 (measured in meters), k is a wavenumber of free space (measured in radians/meter), ω is an angular frequency of the radiation (measured in radians/second), ϵ is a permittivity of free space (measured in Farads/meter), j is $\sqrt{-1}$, and x is the x-coordinate along metastructure 120 (measured in meters). The wavenumber k equals to $k=2\pi/\lambda$.

In at least one embodiments, in order to conserve real power flow across metastructure 120, incident fields $E_z$, $H_x$ may be determined as:

$$E_z = \sqrt{\eta \Re\{E'_z H'^*_x\}}, \tag{6}$$

$$H_x = \frac{E_z}{\eta}, \tag{7}$$

where η is an impedance of free space, roughly equal to η≅120π Ohms.

The incident fields (6)-(7) are such that the phase of the electric field along the surface of metastructure 120 is constant and the real part of the normal component of the Poynting vector is equal on both sides of metastructure 120, such that $\Re\{S'_y\}=\Re\{S_y\}$.

As discussed above, solving equations (1)-(3) with tangential incident fields $E_z$, $H_x$ and transmitted fields $E'_z$, $H'_x$, defined by equations (4)-(7) permits determining metastructure parameters Z, Y, and K.

Although metastructure parameters Z, Y, and K may be determined for specific incident and transmitted fields (so-called "postulated fields"), metastructure 120 refracts a multitude of different beams. Furthermore, beams emitted by phased array 110 may be vastly different from the postulated fields on the incident side of metastructure 120. Therefore, it would be unexpected that metastructure 120 would perform as desired and in a lossless and nearly reflectionless manner with metastructure parameters Z, Y, and K determined based on the postulated fields. However, results of full-field simulations illustrate negligible losses and negligible reflections of EM wave 115 when passing through metastructure 120 with metastructure parameters Z, Y, and K determined based on the postulated fields.

Referring again to FIGS. 1-4, asymmetric impedance layers 131, 132, 133 of unit cells 205, 305, 405 provide coupled electric and magnetic dipole responses. Such coupling of electric and magnetic dipole responses improves performance of metastructure 120 by reducing reflections. The asymmetry of impedance layers 131, 132, 133 may be achieved when metallization elements 340, 440 located in the same unit cell 305, 405 in different impedance layers 131, 132, 133 have different dimensions and/or are shifted with respect to each other.

Referring to FIG. 3, in some embodiments, first metallization element 340*a* and fourth metallization element 340*d* have different lengths 355*a*, 355*d*, respectively, resulting in the asymmetry of impedance layers 131, 133. Similarly, different lengths of capacitance arms 350 of first metallization element 340*a* and fourth metallization element 340*d* may provide asymmetry to first and third impedance layers 131, 133.

Furthermore, dipoles 345*b*, 345*c* of second and third metallization elements 340*b*, 340*c*, located in second (middle) impedance layer 132 may be shifted relative to dipoles 345*a* of first metallization elements 340*a* and/or dipoles 345*d* of fourth metallization elements 340*d* located in first and third impedance layers 131, 133. Such shift of second and third metallization elements 340*b*, 340*c*, compared to first metallization elements 340*a* and/or fourth metallization elements 340*d* may be by approximately half a length of the dipoles located in one or both side impedance layers 131, 133.

The dipoles 345*b*, 345*c* and/or capacitance arms 350 of metallization elements 340*b*, 340*c* located in the middle layer 132 may also have dimensions that are different from dimensions of dipoles 345*a*, 345*d* located in side impedance layers 131, 133. Furthermore, first metallization element 340*a* located in first impedance layer 131 may have dimensions different from dimensions of fourth metallization element 340*d* located in the other side impendence layer, i.e. third impedance layer 133.

Referring now to FIG. 4, dimensions of dipoles 445, 446 and capacitance arms 450, 451 of alternative metallization elements 440*a* in first impedance layer 131 and alternative metallization elements 440*b* in third impedance layer 133 may differ, providing asymmetry to first and second layers 131, 133 and resulting in coupling of electric and magnetic dipole responses.

Dimensions of metallization elements 340, 440 of each unit cell 305, 405 and the asymmetry of impedance layers 131, 132, 133 may be determined based on metastructure parameters Z, Y, and K. As the metastructure parameters Z, Y, and K for neighboring unit cells (e.g. unit cells 305*a*, 305*b* or 405*a*, 405*b*) may be different, dimensions of metallization elements 340, 440 of neighboring unit cells may also be different. In some embodiments, dimensions of dipoles 345, capacitance arms 350, and/or spacing 358 between neighboring capacitance arms 350 for neighboring unit cells (e.g. unit cells 305*a*, 305*b*) is different.

It should be noted that metastructure parameters Z, Y, and K may be determined based on the desired ratio of refracted second angle $\theta_2$ to incident first angle $\theta_1$ of metastructure 120, the frequency of operation of phased array 110, and other characteristics of phased array 110, such as, for example, the number of radiating elements 112.

It should be noted that unit cells 305 with metallization elements 340 depicted in FIG. 3 may operate in single polarization and in two dimensions. Referring also to FIG. 1, in such configuration metastructure 120 and the beams emitted by phased array 110 may be assumed to be uniform and infinitely long in one dimension.

The alternative unit cells 405 with metallization elements 440 depicted in FIG. 4 may operate in two polarizations and in three dimensions due to the configuration of alternative metallization elements 440 (e.g. each one alternative metallization element 440 is symmetric in two dimensions), and positioning of four middle-layer dipoles 470 relative to central elements 460 in middle impedance layer 132.

Metastructures 120 with configurations of metallization elements 140 other than those depicted in FIGS. 3-4 may be configured to provide desired values of metastructure parameters Z, Y, and K. In some embodiments, such metastructures 120 comprise at least three impedance layers 131, 132, 133 arranged in parallel to each other and having a plurality of metallization elements 140. Each metallization element 140 may have a dipole and a pair of capacitance arms located on each end of the dipole approximately perpendicular to that dipole.

Figure 5:
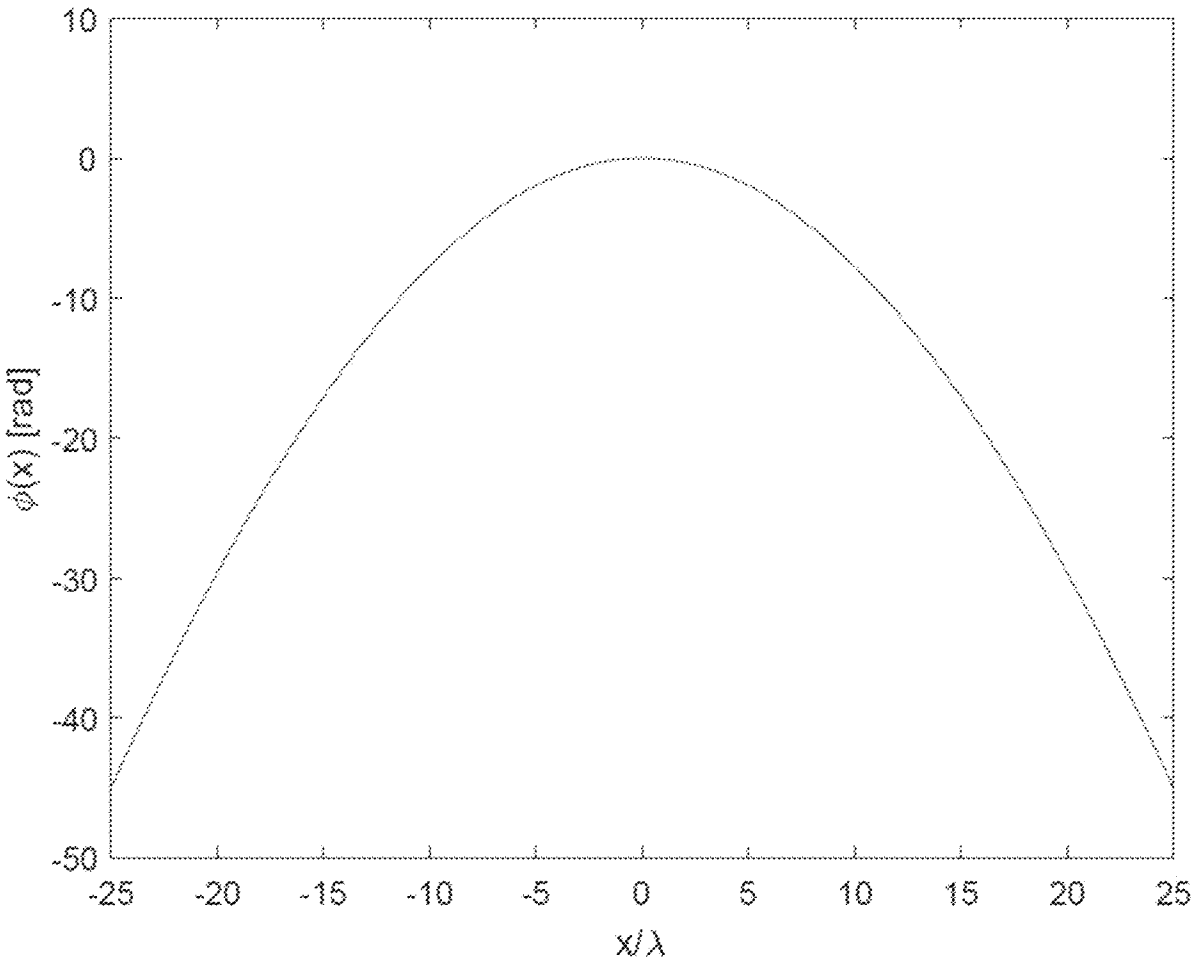
FIG. 5 illustrates a phase as a function of x-coordinate along the metastructure, in accordance with various embodiments of the present disclosure.

FIG. 5 illustrates a phase $\phi$ as a function of x-coordinate along metastructure 120, in accordance with at least one non-limiting embodiment. The relationship between incident first angle $\theta_1$ and refracted second angle $\theta_2$ of the fields at each point of metastructure 120 depends on a slope of phase $\phi$. The function of phase $\phi$ was selected such that it is continuous and refracts at 30 degrees the incident beam falling on metastructure 120 at 15 degrees.

Figure 6A:
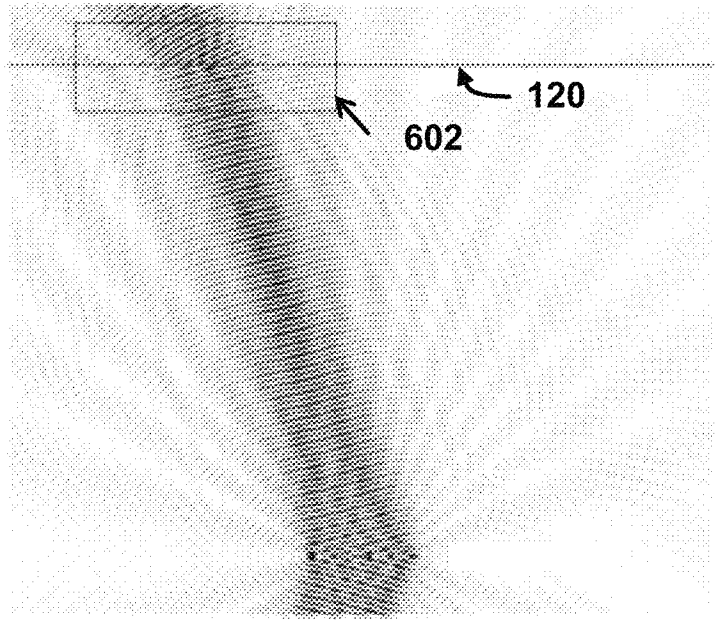
FIG. 6A illustrates simulated behavior of out-of-plane electric field when refracted from the metastructure having unit cells of FIG. 3, in accordance with various embodiments of the present disclosure.

FIG. 6A illustrates simulated behavior of out-of-plane electric field when refracted from metastructure 120 having unit cells 305 in accordance with at least one non-limiting embodiment of the present disclosure. The out-of-plane electric field was simulated using a full-wave finite-element analysis. The phased array 110 had 16 radiating elements 112. The metastructure 120 and phased array 110 were separated by 40λ, as described above. The phased array 110 radiated an off-broadside beam at $\theta_1$=15° degrees, which was refracted by metastructure 120 at $\theta_2$=30° off-broadside.

Figure 6B:
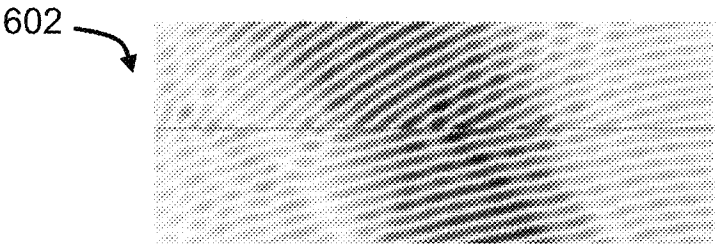
FIG. 6B illustrates an enlarged area A of FIG. 6A.

FIG. 6A illustrates that interference beating of the reflected fields was almost non-existent, which implies the performance was nearly reflectionless. The simulations demonstrated negligible losses and negligible reflection of EM waves from metastructure 120. The reflections remained negligible at other incident angles $\theta_1$. FIG. 6B illustrates an enlarged area 602 of FIG. 6A.

Figure 7:
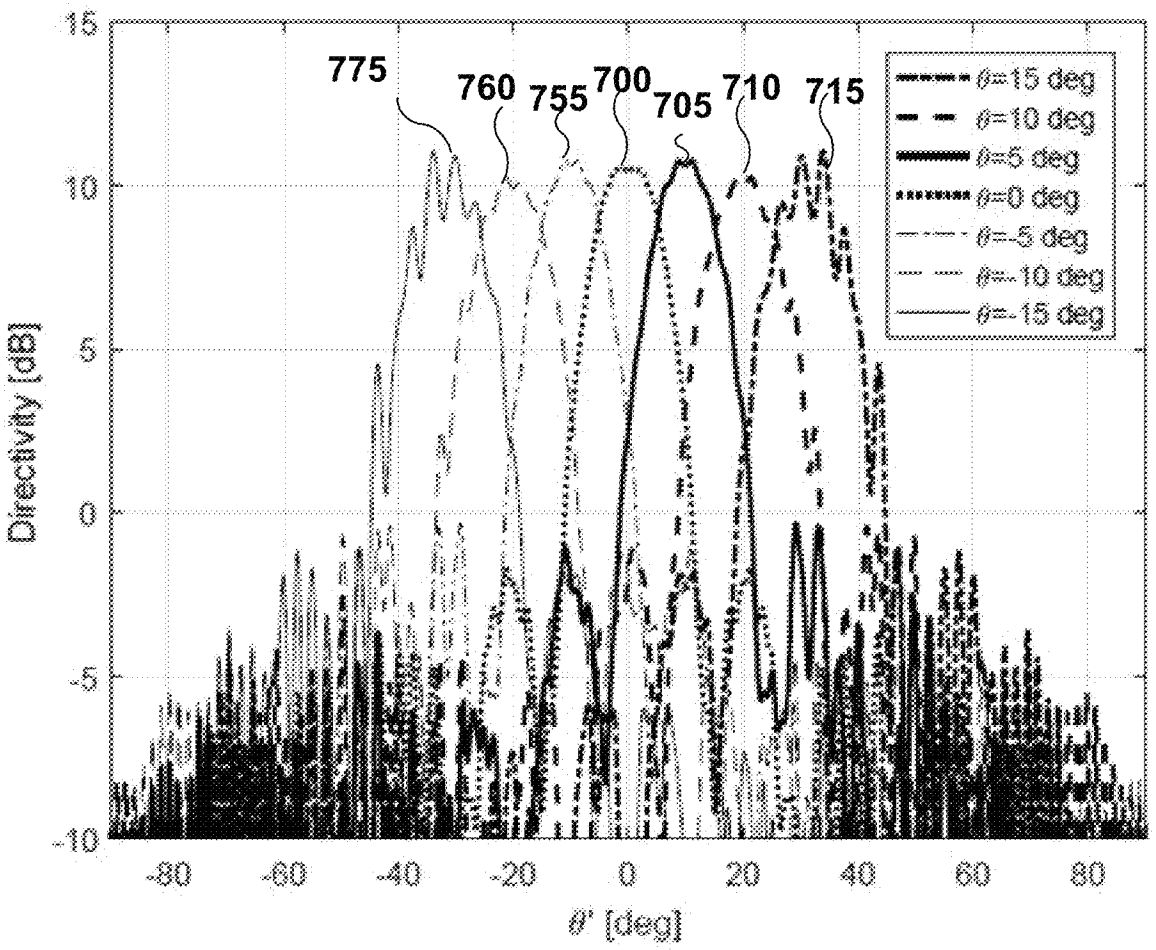
FIG. 7 illustrates refracted directivity patterns for various incident first angles of EM waves for metastructure with the unit cells of FIG. 3, simulated in accordance with various embodiments of the present disclosure.

FIG. 7 illustrates refracted directivity patterns for various incident angles $\theta_1$ of EM waves 115 for metastructure 120 with units cells 305 simulated in accordance with at least one non-limiting embodiment of the present disclosure. The phased array 110 had 1×16 elements and was configured to have first scan range of $\Delta\theta_1$ with $\theta_1$=±15° off broadside. Curves 700, 705, 710, 715 illustrate directivity of EM waves refracted from metastructure 120 at incident first angles of $\theta_1$=0, 5, 10, 15 degrees, respectively. Curves 755, 760, 770 illustrate directivity of EM wave refracted from metastructure 120 at incident first angle $\theta_1$=−5, −10, −15 degrees, respectively.

FIG. 7 illustrates that in the simulated embodiment, the peak of the directivity at various incident first angles $\theta_1$ had similar values. With reference also to FIG. 1, when incident first angle $\theta_1$ of incident EM wave 115 was $\theta_1$=10 degrees, the peak of directivity 710 of the refracted EM wave 116 was at second angle $\theta_2$=20 degrees. Thus in the simulated embodiment, antenna 100 was configured to radiate refracted EM wave 116 at second angle $\theta_2$ which was two times larger than first angle $\theta_1$.

If the angle of operation of phased array 110 is first angle $\theta_1$, metastructure 120 may double that angle and antenna 100 may operate (radiate and receive EM waves) at second angle $\theta_2=2*\theta_1$.

Figure 8:
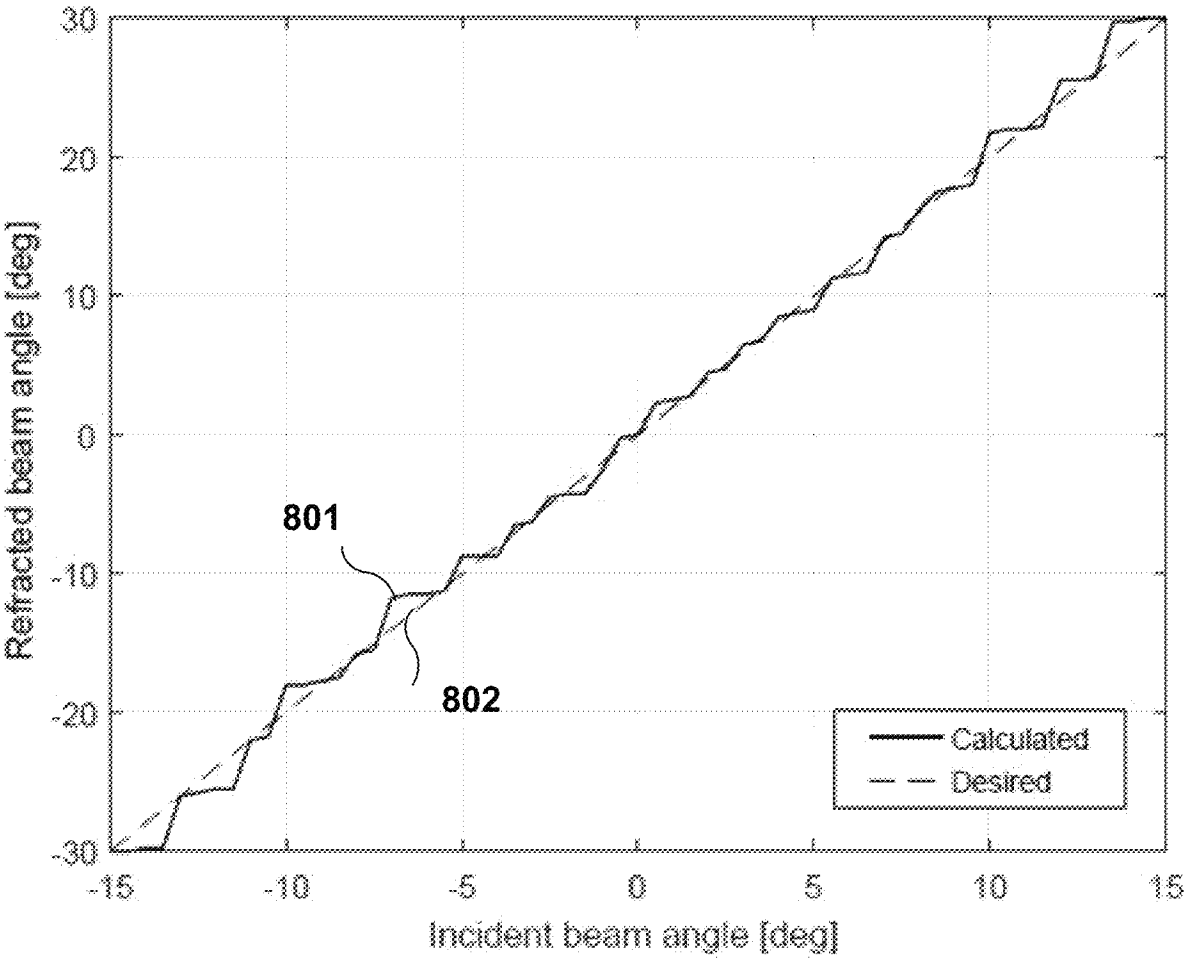
FIG. 8 depicts a refracted second angle as a function of an incident first angle in simulations illustrated in FIG. 7.

FIG. 8 depicts refracted second angle $\theta_2$ as a function of incident first angle $\theta_1$ in simulations of FIG. 7. Curve 801 illustrates simulated refracted second angle $\theta_2$ of EM wave 116, while curve 802 corresponds to the desired behavior of refracted second angle $\theta_2$ of EM wave 116 as a function of incident angle $\theta_1$ of EM wave 115. FIG. 8 illustrates that second angle $\theta_2$ was two times larger than incident first angle $\theta_1$.

Figure 9:
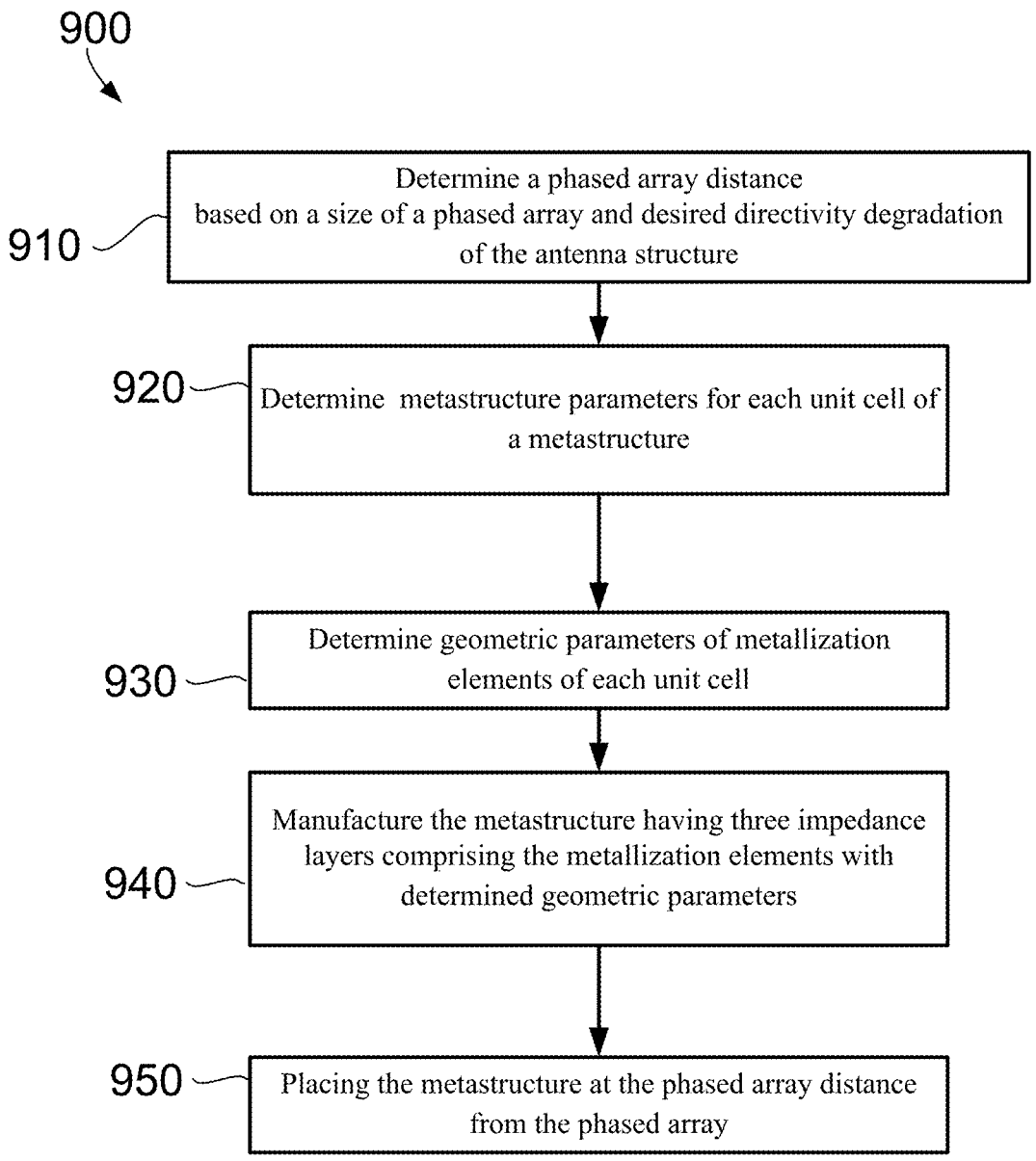
FIG. 9 illustrates a flowchart of a method for manufacturing of the antenna, in accordance with various embodiments of the present disclosure.

FIG. 9 illustrates a flowchart of a method 900 for manufacturing of antenna 100, in accordance with at least one non-limiting embodiment of the present disclosure. At step 910, phased array distance 125 is determined, e.g. based on a size of phased array 110 and a desired directivity degradation of antenna 100. The size of phased array 110 may be determined based on the number of radiating elements 112 of phased array 110.

At step 920, metastructure parameters Z, Y, and K are determined for each unit cell 205, 305, 405 of metastructure 120. As described above, metastructure parameters Z, Y, and K may be determined using equations (1)-(7). The metastructure parameters Z, Y, and K for unit cells 205, 305, 405 of metastructure 120 may be determined based on the frequency of operation of phased array 110 and based on a desired ratio of second scan range $\Delta\theta_2$ of antenna 100 to first scan range $\Delta\theta_1$ of phased array 110.

At step 930, geometric parameters of metallization elements 140, 340, 440, 460, 470 of each unit cell 205, 305, 405 are determined based on metastructure parameters Z, Y, and K. At step 940, metastructure 120 may be manufactured with geometric parameters of metallization elements 140, 340, 440 determined at step 930. In at least one embodiment, metastructure 120 has at least three impedance layers 131, 132, 133, and each layer comprises metallization elements 140, 340, 440 with geometric parameters determined at step 930. At step 950, metastructure 120 is placed at phased array distance 125 from phased array 110 to form antenna 100.

Although the present invention has been described with reference to specific features and embodiments thereof, it is evident that various modifications and combinations can be made thereto without departing from the invention. The specification and drawings are, accordingly, to be regarded simply as an illustration of the invention as defined by the appended claims, and are contemplated to cover any and all modifications, variations, combinations or equivalents that fall within the scope of the present invention.

The invention claimed is:

1. An antenna for transmission of electromagnetic (EM) waves, comprising:

a phased array arrangement having radiating elements configured to radiate uniform angular and polarized EM waves within a first scan range;

a planar metastructure having a first surface positioned parallel to and at a distance from the phased array arrangement, the planar metastructure configured to receive the uniform angular and polarized EM waves incident on the first surface at a first angle, the distance being relative to a free-space wavelength corresponding to a frequency of operation of the antenna, and the first angle being defined between the incident EM waves and a normal of the first surface of the planar metastructure and relative to the first scan range, and the planar metastructure having a second surface opposite to the first surface, the planar metastructure configured to transmit the received EM waves from the second surface at a second angle, the second angle being defined between the transmitted EM waves and the normal of the first surface of the planar metastructure and relative to a second scan range, the second angle being greater in a same direction of rotation than the first angle to expand angular coverage from the first scan range to the second scan range, wherein the planar metastructure comprises:

three impedance layers arranged in parallel to each other, each impedance layer comprising a plurality of metallization elements, each metallization element having a first dipole and a pair of first capacitance arms positioned on each end of the first dipole approximately perpendicular to the first dipole.

2. The antenna of claim 1, wherein the plurality of metallization elements is configured to provide coupled electric and magnetic dipole responses.

3. The antenna of claim 1, wherein the three impedance layers comprise a pair of side impedance layers and a middle impedance layer located between the side impedance layers, and wherein first dipoles located in the middle impedance layer are shifted relative to first dipoles located in the side impedance layers.

4. The antenna of claim 3, wherein the first dipoles located in the middle layer are shifted relative to the first dipoles located in the side impedance layers by approximately half a length of the first dipole located in the side impedance layers.

5. The antenna of claim 1, wherein:

the three impedance layers comprise a pair of side impedance layers and a middle impedance layer located between the side impedance layers, and the planar metastructure comprises at least one unit cell having portions of the three impedance layers, in which the at least one unit cell comprises one metallization element in each of the side impedance layers and at least portions of middle-layer metallization elements in the middle impedance layer.

6. The antenna of claim 5, wherein, in the at least one unit cell, at least one of the middle-layer metallization elements located in the middle impedance layer has dimensions different from dimensions of the one metallization element located in each of the side impedance layers.

7. The antenna of claim 5, wherein metallization elements located in the side impedance layers of the at least one unit cell have different dimensions.

8. The antenna of claim 1, wherein the three impedance layers comprise a pair of side impedance layers and a middle impedance layer located between the side impedance layers, and each metallization element located in the side impedance layers further comprises:

a second dipole positioned approximately perpendicular to the first dipole and crossing the first dipole, and a pair of second capacitance arms positioned on each end of the second dipole approximately perpendicular to the second dipole.

9. The antenna of claim 8, wherein the middle impedance layer further comprises central elements surrounded by the first capacitance arms of neighboring metallization elements located in the middle impedance layer.

10. The antenna of claim 9, wherein the neighboring metallization elements located in the middle impedance layer further comprise third dipoles positioned approximately perpendicular to the first dipole located in the middle impedance layer and a pair of third capacitance arms positioned on each end of the third dipole approximately perpendicular to the third dipole.

11. The antenna of claim 1, wherein the first and second surfaces are parallel.

12. The antenna of claim 1, wherein the planar metastructure has a positive refraction index.

13. The antenna of claim 1, wherein the distance from the phased array arrangement is $40\lambda$, where $\lambda$ represents the free-space wavelength corresponding to a frequency of operation of the antenna.

* * * * *